US011519671B2

(12) United States Patent
Bhaskar et al.

(10) Patent No.: US 11,519,671 B2
(45) Date of Patent: Dec. 6, 2022

(54) EVAPORATOR FOR WATER HEATING DEVICE

(71) Applicant: Rheem Manufacturing Company, Atlanta, GA (US)

(72) Inventors: Mukund Bhaskar, Montgomery, AL (US); Tobey Fowler, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 319 days.

(21) Appl. No.: 16/939,605

(22) Filed: Jul. 27, 2020

(65) Prior Publication Data

US 2022/0026153 A1 Jan. 27, 2022

(51) Int. Cl.

| | |
|---|---|
| ***F28D 1/053*** | (2006.01) |
| ***F24H 6/00*** | (2022.01) |
| *F28D 21/00* | (2006.01) |

(52) U.S. Cl.

CPC ..... *F28D 1/05391* (2013.01); *F24H 6/00* (2013.01); *F28D 2021/0071* (2013.01)

(58) Field of Classification Search

CPC ..... F25D 1/05391; F24H 6/00; F24H 4/04; F28D 2021/0071; F28D 2001/0273; F28F 2260/02

See application file for complete search history.

(56) References Cited

U.S. PATENT DOCUMENTS

| | | | | |
|---|---|---|---|---|
| 2,632,306 A * | 3/1953 | Ruff | F24F 5/00 62/506 |
| 2,716,866 A * | 9/1955 | Silva | F24H 4/04 122/26 |
| 4,290,275 A | 9/1981 | Disco et al. | |
| 4,320,630 A * | 3/1982 | Uselton | F25B 30/02 62/238.6 |

(Continued)

FOREIGN PATENT DOCUMENTS

| | | |
|---|---|---|
| CN | 206637842 U | 11/2017 |
| DE | 254004 A1 | 3/1977 |

(Continued)

OTHER PUBLICATIONS

International Search Report and Written Opinion for PCT Application No. PCT/US2021/042681 dated Oct. 28, 2021.

*Primary Examiner* — Emmanuel E Duke

(74) *Attorney, Agent, or Firm* — Eversheds Sutherland (US) LLP

(57) ABSTRACT

The disclosed technology includes an evaporator having a plurality of sidewalls arranged to define an internal cavity and a top plate covering the internal cavity. At least one of the sidewalls can include a plurality of refrigerant channels such that at least one of the sidewalls can function as a heat exchanger. Each of the refrigerant channels can be attached to a refrigerant inlet and a refrigerant outlet at an angle, such that each refrigerant channel is angled. The angled refrigerant channels can facilitate directing ambient air across the refrigerant channels and fins and to the internal cavity. The (Continued)

angled refrigerant channels can further provide a flow path for accumulated moisture and/or condensate on the exterior surfaces of the refrigerant channels and/or fins to shed, thereby minimizing the potential for freezing.

20 Claims, 7 Drawing Sheets

(56) References Cited

U.S. PATENT DOCUMENTS

| | | | | |
|---|---|---|---|---|
| 9,109,811 | B2 * | 8/2015 | Duplessis | F24H 4/04 |
| 10,281,170 | B2 * | 5/2019 | Sukumaran | F25B 1/00 |
| 2019/0128565 | A1 * | 5/2019 | Pugh | F24D 19/1054 |

FOREIGN PATENT DOCUMENTS

| | | | |
|---|---|---|---|
| RU | 2226659 | C2 | 4/2004 |
| WO | 2003/106902 | A1 | 12/2003 |

* cited by examiner

EVAPORATOR FOR WATER HEATING DEVICE

FIELD OF THE DISCLOSURE

The present invention relates generally to an evaporator for use with a water heating device, and more particularly to an evaporator for use with a heat pump water heater. The disclosed technology includes an evaporator (e.g., a microchannel evaporator) that has a shroud-like structure such that the evaporator can also function as an air movement shroud as described more fully herein.

BACKGROUND

A heat pump water heater typically includes a heat pump configured to acquire heat from air ambient and convey the acquired heat to water in the tank of the water heater via a heat exchanger. A fan is often used to direct warm ambient air across a heat exchanger (e.g., an evaporator) through which a refrigerant is flowing in liquid form. The warm ambient air will increase the temperature of the liquid refrigerant, causing the refrigerant to transition from a liquid state to a vapor state. A compressor will typically increase the pressure of the vapor refrigerant, thereby raising the temperature of the vapor refrigerant, and the heated vapor refrigerant will be directed through a condenser coil surrounding the water tank, which will increase the temperature of the water in the tank. As the water in the tank acquires heat from the vapor refrigerant, the vapor transitions back to a liquid state, and the cycle can repeat. Heat pump water heaters can provide a variety of advantages including energy savings and costs savings, as heat pump water heaters can transfer heat from ambient air to water in a storage tank, as opposed to solely heating water with a resistive heating element, for example.

FIGS. 1A and 1B illustrate a heat pump water heater 100 according to the prior art. The illustrated heat pump water heater 100 includes a finned-tube evaporator 102. The finned-tube evaporator 102 can include a tube coil configured to carry refrigerant and fins (i.e., metal plates) to increase the heat transfer area. A fan 106 can pull ambient air across the evaporator 102, and the heat pump water heater 100 can include an air-flow guide or shroud 104, which is typically positioned proximate the evaporator 102 and the fan 106, to better direct the ambient air across the evaporator 102. As illustrated in FIG. 1B, an outer jacket 108 can be positioned over a top portion of the heat pump water heater 100, such that the outer jacket 108 surrounds the evaporator 102 and other components of the heat pump water heater 100 disposed within the top portion. The heat pump water heater 100 can require the outer jacket 108 to provide structural stability and protection of components of the heat pump water heater 100 (e.g., the compressor) and/or protection of users and technicians from the components of the heat pump water heater 100 (e.g., the spinning blades of the fan 106). This additional component can result in a multitude of parts and, thereby increasing manufacturing and labor costs and time for installation and maintenance.

Microchannel heat exchangers have been designed to improve heat transfer efficiency as compared to finned-tube evaporators. Microchannel heat exchangers can include a plurality of ports configured to carry refrigerant. Microchannel heat exchangers can provide a variety of advantages including high heat transfer ratios, reduced refrigerant charge, small and compact design, low weight, and high energy efficiency. However, microchannel heat exchangers can be susceptible to freezing and/or fowling. When ambient air is directed across the microchannel heat exchanger, moisture and condensate from the ambient air can collect on exterior surfaces of the microchannel heater. Without a pathway to remove accumulated moisture and/or condensate, freezing can occur, thereby decreasing the lifespan of the microchannel heat exchanger and increasing the need for continuous maintenance.

SUMMARY

These and other problems can be addressed by the technologies described herein. Examples of the present disclosure relate generally to an evaporator having a plurality of sidewalls, where at least one sidewall can function as a heat exchanger.

The disclosed technology includes an evaporator having a plurality of sidewalls arranged to define an internal cavity. At least one of the sidewalls can include a plurality of refrigerant channels. The evaporator can further include a top plate covering the internal cavity.

Each refrigerant channel can include a plurality of ports configured to provide a refrigerant flow path from a refrigerant inlet to a refrigerant outlet. Each refrigerant channel can be angled such that ambient air can be directed across the plurality of refrigerant channels and into the internal cavity.

The disclosed technology further includes a heat pump water heater including a first portion and a second portion. The first portion can include an evaporator and a compressor. The evaporator can have a plurality of sidewalls arranged to define an internal cavity. At least one of the sidewalls can include a plurality of refrigerant channels. A top plate can cover the internal cavity. The top plate can include an aperture configured to receive a fan. The second portion can include a storage tank and a condenser coil in thermal communication with the storage tank.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

Reference will now be made to the accompanying figures, which are not necessarily drawn to scale, and wherein.

DETAILED DESCRIPTION

Figure 1A:
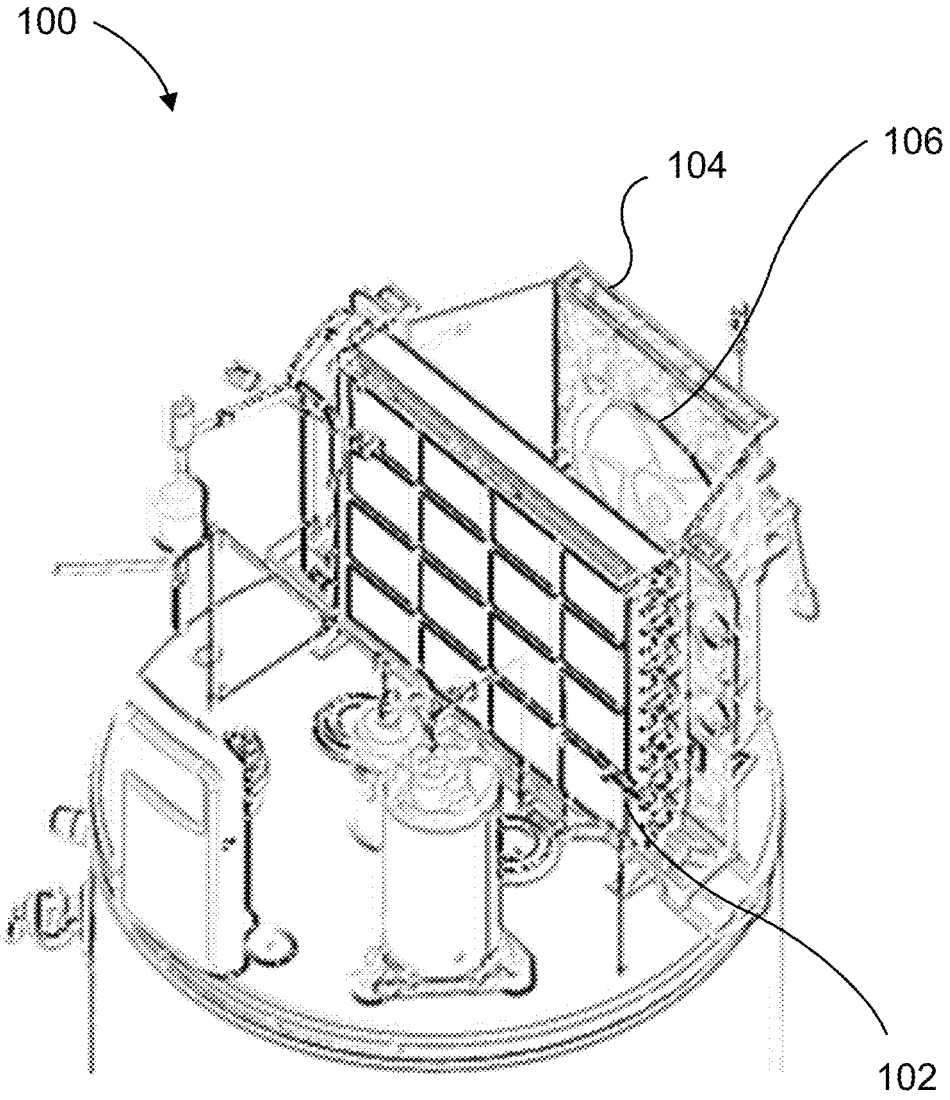
FIG. 1A PRIOR ART
FIGS. 1A and 1B illustrate portions of a prior art heat pump water heater.

The disclosed technology relates an evaporator having a plurality of sidewalls arranged to define an internal cavity. At least one of the sidewalls can include a plurality of refrigerant channels such that at least one of the sidewalls can function as a heat exchanger. The refrigerant channels can extend from a refrigerant inlet to a refrigerant outlet and can be stacked upon one another to create parallel refrigerant channels. Each refrigerant channel can include a plurality of ports extending the length of the refrigerant channel. The ports can be configured to direct refrigerant from the refrigerant inlet to the refrigerant outlet. A plurality of fins can be disposed between adjacent refrigerant channels to facilitate the transfer of heat from ambient air to the refrigerant flowing through the ports. Each of the refrigerant channels can be attached to the refrigerant inlet and the refrigerant outlet at an angle. The angled refrigerant channels can facilitate directing ambient air across the refrigerant channels and fins and to the internal cavity, which can reduce turbulence and/or parasitic loss of static pressure for the system, thereby eliminating the need for a separate air movement shroud and improving efficiency of the system. Additionally, the angled refrigerant channels can provide a flow path for accumulated moisture and/or condensate on the exterior surfaces of the refrigerant channels and/or fins. The flow path can allow accumulated moisture and/or condensate to shed from the components of the evaporator, thereby minimizing freezing and/or fouling. As will be appreciated, if ice crystals nucleate on the fins and continue to grow and/or expand, the ice/frost formation can cause a blockages and/or restriction of the air flow across the heat exchanger, which will typically diminish the efficiency of the heat pump system and could ultimately cause the heat pump system to completely shut down due to integrated failsafe features. By minimizing the chance of components of the evaporator freezing and/or fouling, the lifespan of the evaporator and/or the heat pump system can be extended (e.g., by preventing damage to the heat pump system).

The disclosed technology will be described more fully hereinafter with reference to the accompanying drawings. This disclosed technology can, however, be embodied in many different forms and should not be construed as limited to the examples set forth herein. The components described hereinafter as making up various elements of the disclosed technology are intended to be illustrative and not restrictive. Such other components not described herein may include, but are not limited to, for example, components developed after development of the disclosed technology.

In the following description, numerous specific details are set forth. But it is to be understood that examples of the disclosed technology can be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," "one example,' "an example," "some examples," "certain examples," "various examples," etc., indicate that the embodiment(s) and/or example(s) of the disclosed technology so described may include a particular feature, structure, or characteristic, but not every embodiment necessarily includes the particular feature, structure, or characteristic. Further, repeated use of the phrase "in one embodiment" or the like does not necessarily refer to the same embodiment, example, or implementation, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

Unless otherwise specified, all ranges disclosed herein are inclusive of stated end points, as well as all intermediate values. By way of example, a range described as being "between approximately 2 and approximately 4" includes the values 2 and 4 and all intermediate values within the range. Likewise, the expression that a property "can be in a range from approximately 2 to approximately 4" (or "can be in a range from 2 to 4") means that the property can be approximately 2, can be approximately 4, or can be any value therebetween.

As used herein, the term "shroud" is used to describe a housing or similar structure. As described more fully herein, the disclosed shrouds can substantially direct airflow therethrough. For example, a shroud can direct airflow from an inlet (e.g., over evaporator coils) to an outlet (e.g., a fan aperture).

Figure 2:
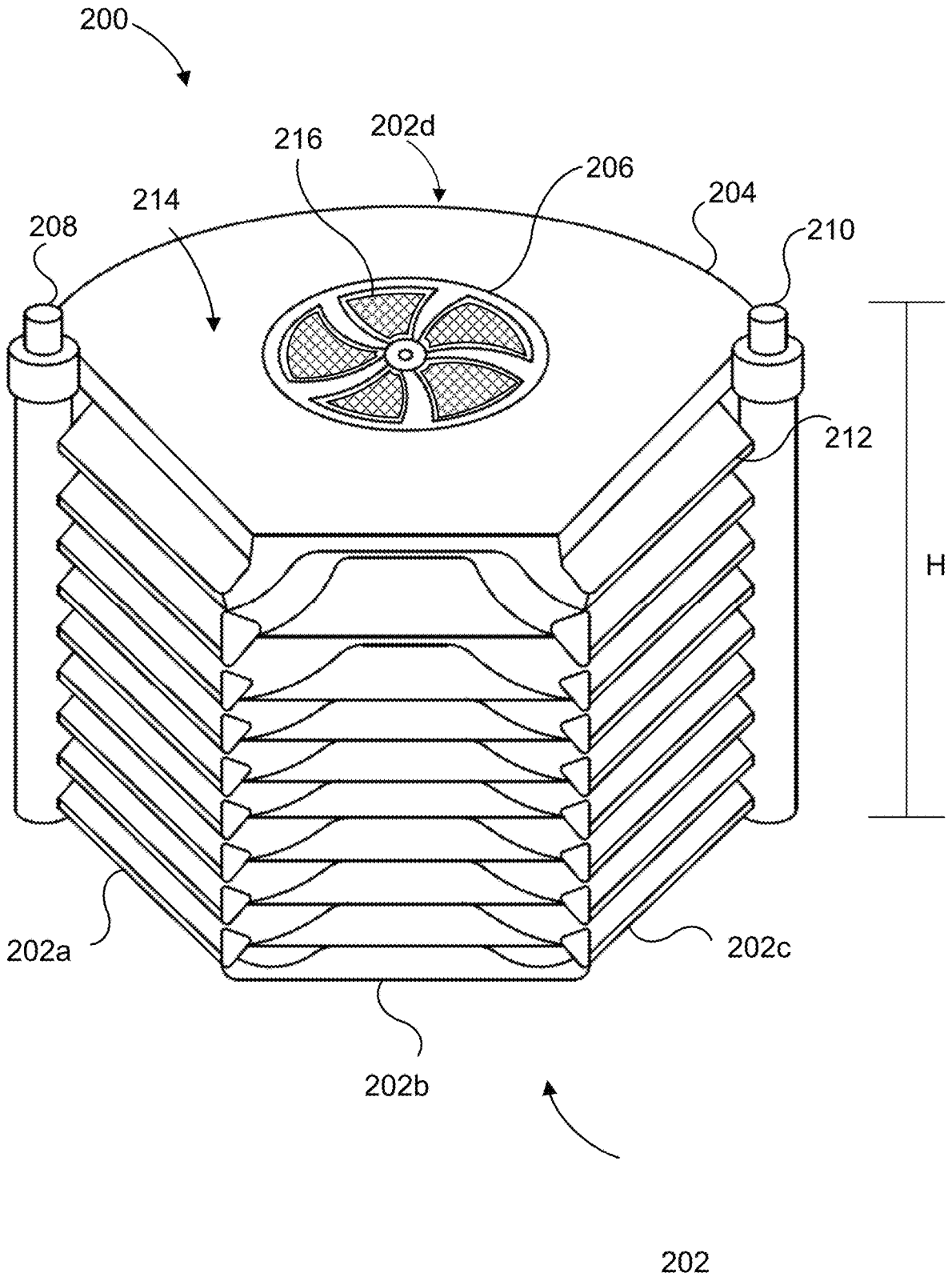
FIG. 2 illustrates a front perspective view of an example evaporator, in accordance with the disclosed technology.

Referring now to the drawings, FIG. 2 illustrates a front perspective view of an example evaporator 200. The evaporator 200 can include a plurality of sidewalls 202 configured to define an internal cavity 214. The evaporator 200 can include any number of sidewalls 202. At least one of the sidewalls 202 can be configured to function as a heat exchanger when ambient air is directed to the internal cavity 214, as discussed further herein. As illustrated in FIG. 2, the evaporator 200 can include a first sidewall 202*a*, a second sidewall 202*b*, and a third sidewall 202*c* arranged in a portion of a polygonal configuration (e.g., a partial polygonal shape). By way of example, the first sidewall 202*a*, the second sidewall 202*b*, and the third sidewall 202*c* can be arranged in a substantially trapezoidal configuration (i.e., a cross-section of the first, second, and third sidewalls 202*a*, 202*b*, 202*c* can form at least a portion of a generally trapezoidal shape). In this configuration, the sidewalls 202*a*, 202*b*, 202*c* can be substantially flat such that each of the sidewalls 202*a*, 202*b*, 202*c* can be coupled to an adjacent sidewall at an angle (i.e. the first sidewall 202*a* can be coupled to the second sidewall 202*b* at an angle and the second sidewall 202*b* can be connected to the third sidewall 202*c* at an angle). Alternatively, the first sidewall 202*a*, the second sidewall 202*b*, and the third sidewall 202*c* can be configured to form one or more curves, such as a single, continuous curve, for example. The evaporator 200 can include additional sidewalls, such as a fourth sidewall 202*d*. For example, the fourth sidewall 202*d* can be substantially curved. As another example, the additional sidewalls can include a number of flat sides, such as an arrangement similar to that of the first, second, and third sidewalls 202*a*, 202*b*, 202*c* shown in FIG. 2. The fourth sidewall 202*d* can be configured to not function as a heat exchanger. That is, in side instances, the evaporator 200 can include one or more sidewalls 202 that include components enabling those sidewalls to function as a heat exchanger, and the evaporator 200 can also include one or more sidewalls that do not include components capable of functioning as a heat exchanger (e.g., a simple wall or barrier). Alternatively, all sidewalls 202 of the evaporator 200 can include components capable of functioning as a heat exchanger.

The evaporator 200 can include a top plate 204 covering the internal cavity 214. The top plate 204 can be made substantially of a metal. By way of example, the top plate 204 can be made substantially of aluminum, copper, steel, or alloys thereof. The top plate 204 can be made of plastic or anything other material. The top plate 204 can have an aperture sized to receive a fan 206. The fan 206 can include any type of air movement device, such as an axial-flow fan, a centrifugal fan, or the like. The fan 206 can be positioned at the center of the top surface 204, for example. Alternatively, the fan 206 can be positioned off-center at any location on the top plate 204. A filter 216 can be disposed at or proximate an outlet of the fan 206. The filter 216 can prevent contaminant particles (e.g., dust particles) within the ambient air from being drawn into the internal cavity 214 of the evaporator 200. The filter 216 can be particularly beneficial when the evaporator 200 is a component of a heat pump water heater that is located within a garage or attic of a home or building.

As will be appreciated, the evaporator 200 is expressly described herein as being configured to be located on top of a tank or vessel. For example, the described evaporator can be used with, and located on top of, a tank or vessel of a water heater system. It is to be understand that the disclosed technology is not limited to such configurations. For example, the evaporator 200 can include a bottom plate (e.g., in lieu of, or in addition to, the top plate 204), and/or the evaporator 200 can be configured to be located beneath or below a tank or vessel of a water heater system.

The evaporator 200 can include a refrigerant inlet 208 and a refrigerant outlet 210. The refrigerant inlet 208 and the refrigerant outlet 210 can be vertically oriented tubes. The refrigerant inlet 208 and the refrigerant outlet 210 can be substantially cylindrical tubes having a circular cross-section. Alternatively, the refrigerant inlet 208 and the refrigerant outlet 210 can have any shape and have any cross-sectional shaped, including but not limited to a substantially ellipsoid, rectangular, or polygonal cross-section.

The refrigerant inlet 208 and the refrigerant outlet 210 can be attachment points for a plurality of refrigerant channels 212 extending from the refrigerant inlet 208 to the refrigerant outlet 210. At least one of the sidewalls 202 can include the plurality of refrigerant channels 212 such that at least one of the sidewalls 202 can be configured to function as a heat exchanger. As illustrated in FIG. 2, the first sidewall 202*a*, the second sidewall 202*b*, and the third sidewall 202*c* can include a plurality of refrigerant channels 212. However, the fourth sidewall 202*d* can be free of any refrigerant channels 212. The refrigerant inlet 208 and the refrigerant outlet 210 can each be adjacent to two of the sidewalls 202. The refrigerant inlet 208 and the refrigerant outlet 210 can each be adjacent to a sidewall 202 configured to function as a heat exchanger (i.e. a sidewall including the plurality of refrigerant channels 212) and a sidewall that is not configured to function as a heat exchanger. By way of example, the refrigerant inlet 208 can be disposed between the first sidewall 202*a* and the fourth sidewall 202*d* and the refrigerant outlet 210 can be disposed between the third sidewall 202*a* and the fourth sidewall 202*d*.

A first end of each refrigerant channel 212 can be affixed to the refrigerant inlet 208 and a second end of each refrigerant channel 212 can be affixed to the refrigerant outlet 210 such that the refrigerant inlet 208, the refrigerant outlet 210, and the refrigerant channels 212 are in fluid communication. The first end of each refrigerant channel 212 can be affixed to the refrigerant inlet 208 and the second end of each refrigerant channel 212 can be affixed to the refrigerant outlet 210 at an angle, as further discussed herein. The refrigerant channels 212 can be vertically stacked upon one another to form parallel refrigerant channels 212. The refrigerant channels 212 can be equally spaced apart from one another such that a gap between adjacent refrigerant channels 212 is created. By way of example, each refrigerant channel 212 can be spaced apart from an adjacent channel by approximately 6 millimeters to approximately 12 millimeters. The evaporator 200 can include any number of channels 212. The evaporator 200 can have a height H that is between approximately 5 inches and approximately 20 inches.

Each refrigerant channel 212 can have a substantially flat exterior surface. Alternatively, some or all of the refrigerant channels 212 can have surface features. By way of example, some or all of the refrigerant channels 212 can have bends, twists, turns, protrusions or other geometries, and the like. These surface features can provide aerodynamic enhancements when ambient air is directed across the plurality of refrigerant channels and into the internal cavity 214. As will be appreciated, that particular geometry of a given refrigerant channel 212 or set of refrigerant channels 212 can be designed to provide optimal air flow for a given application, thereby provided an increased or maximized efficiency and/or performance for the corresponding design and application.

The plurality of refrigerant channels 212 can be made substantially of a metal. The plurality of refrigerant channels 212 can be made substantially of aluminum and/or aluminum alloys. Optionally, the plurality of refrigerant channels 212 can have a hydrophobic coating. The hydrophobic coating can prevent excess moisture and/or condensate from accumulating on the refrigerant channels 212.

Figure 1B:
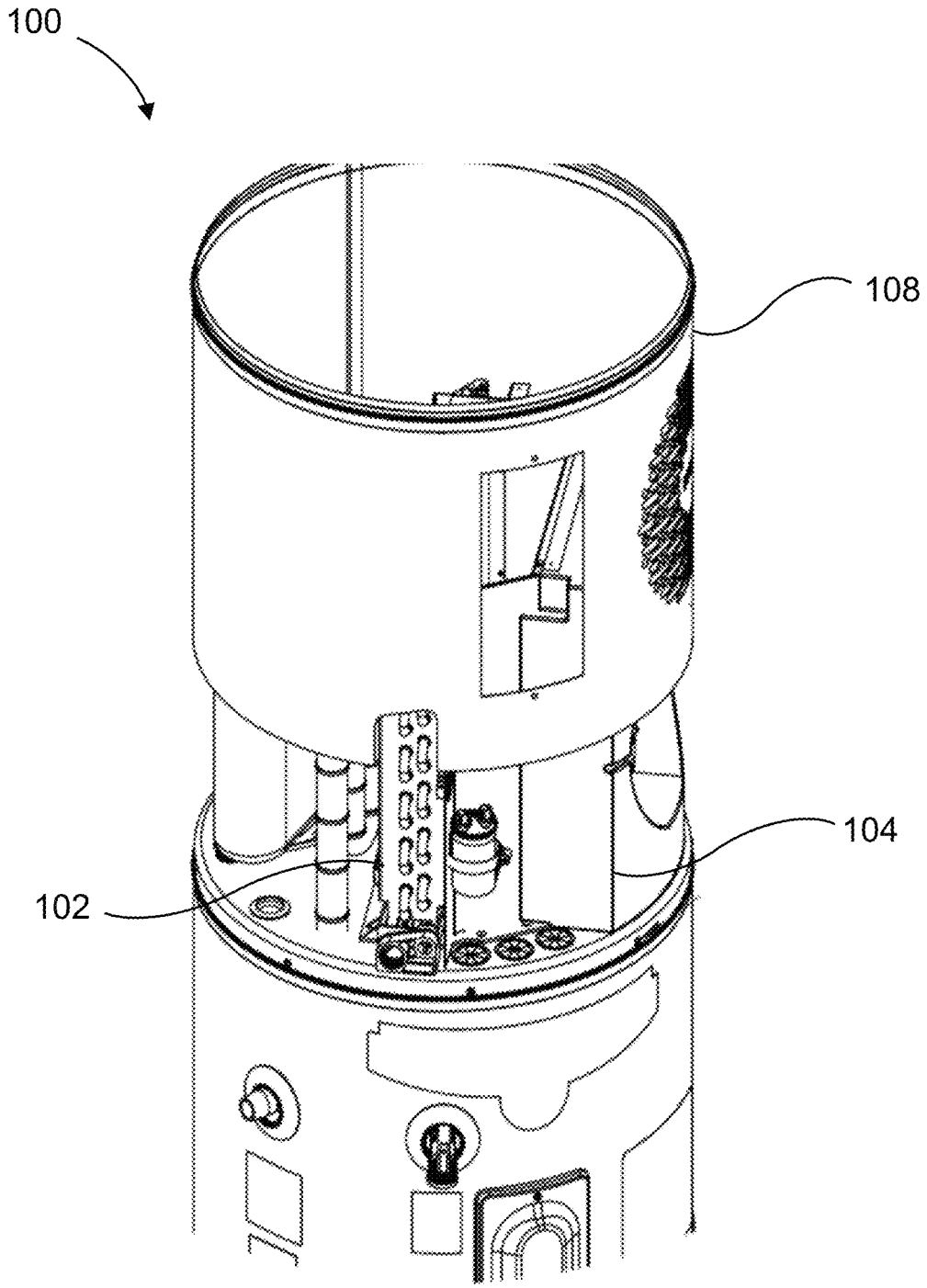
FIG. 1B PRIOR ART
Figure 3A:
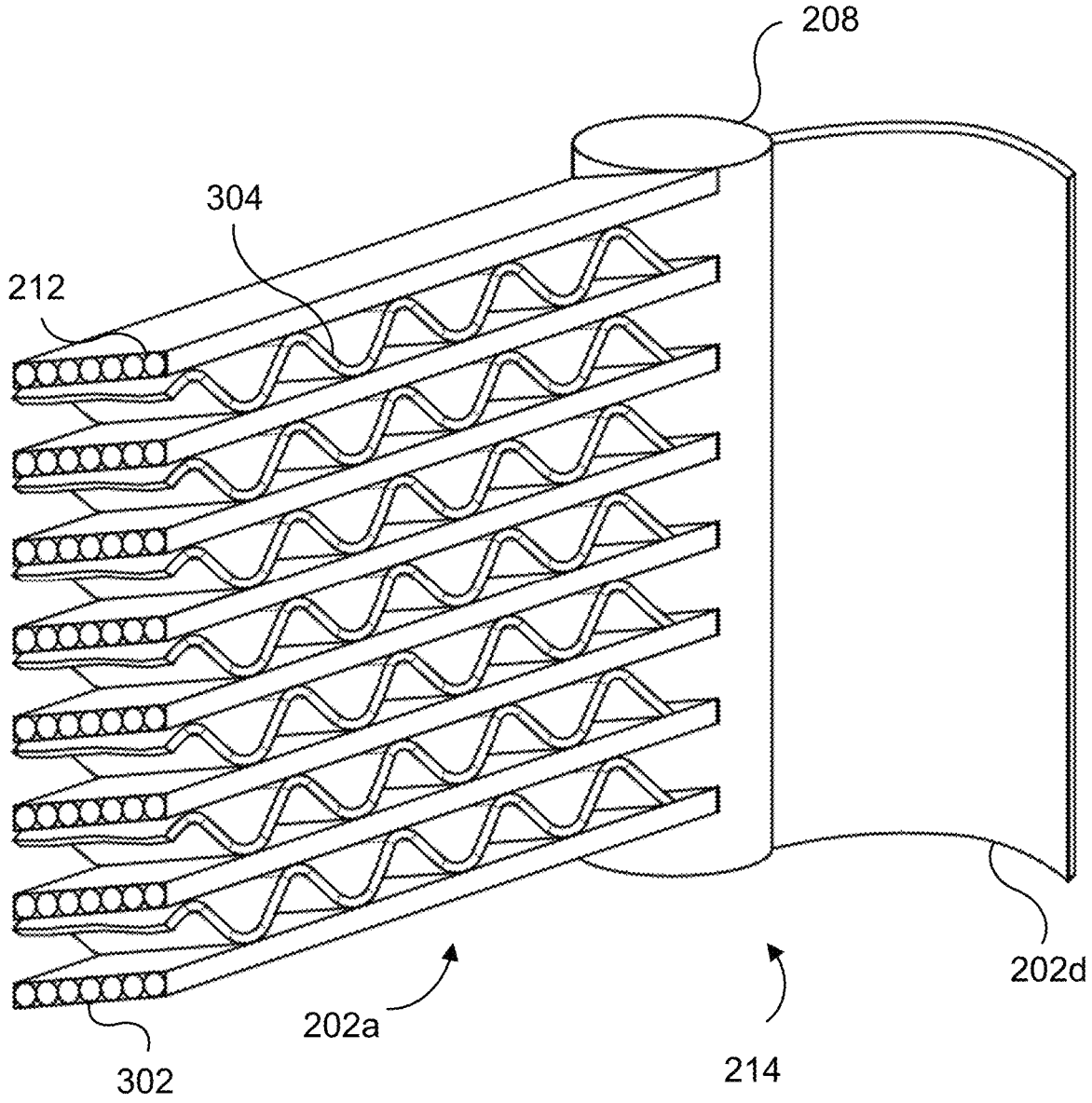
FIG. 3A illustrates a cutaway view of the example evaporator illustrated in FIG. 2, in accordance with the disclosed technology.

FIG. 3A illustrates a cut-out portion of the example evaporator 200 illustrated in FIG. 2. The refrigerant inlet 208 can be coupled to the substantially curved sidewall 202*d* and the first sidewall 202*a*. The first end of each refrigerant channel 212 can be affixed to the refrigerant inlet 208 at an angle. Although not shown, the second end of the refrigerant channel can be affixed to the refrigerant outlet 210 at the same angle such that each refrigerant channel 212 is angled along the entire length of the refrigerant channel 212. Each refrigerant channel 212 can be angled upward and radially inward toward the center of the internal cavity 214, as illustrated in FIG. 3A. Alternatively, each refrigerant channel can be angled downward and radially inward toward the center of the internal cavity 214. When in operation, the fan 206 can draw ambient air across the sidewalls 202 including angled refrigerant channels 212 and into the internal cavity 214. In this sense, the sidewalls 202 including the refrigerant channels 212 can function as an air movement shroud, thereby eliminating the need for a separate air movement shroud as compared to the prior art heat pump water heater 100 illustrated in FIGS. 1A and 1B. Without needing to manufacture both an evaporator and an air movement shroud, the evaporator 200 provides for reduced manufacturing costs and assembly time.

Additionally, by having multiple sidewalls 202 include refrigerant channels 212, ambient air can be directed across the refrigerant channels 212 extending along a large exterior surface area of the evaporator 200. By increasing the exterior surface area in which ambient air can be directed across the refrigerant channels 212 as compared to the prior art, the evaporator 200 can have improved heat transfer capabilities. The improved heat transfer capabilities can allow the size of the fan 206 can be reduced. When the size of the fan 206 is reduced, efficiency can be increased and noise during operation can be decreased.

Each refrigerant channel 212 can include a plurality of ports 302. By way of example, each refrigerant channel 212 can include between approximately 25 and approximately 30 ports 302. Each port 302 can provide a refrigerant flow path. By way of example, refrigerant from the refrigerant inlet 208 can flow through the plurality of ports 302 of the plurality of refrigerant channels 212 and to the refrigerant outlet 210. Each port 302 can extend from the refrigerant inlet 208 to the refrigerant outlet 210 such that the ports 302 traverse the entire length of refrigerant channel 212. The ports 302 can be substantially cylindrical and have a circular cross-section. Alternatively, the ports 302 can be partially flattened such that the ports 302 have a substantially rectangular, oval, ellipsoid, or the like cross-section. Each port 302 can have a diameter of between approximately 0.5 millimeter and approximately 1.5 millimeters. The ports 302 can be made substantially of a metal and/or metal alloy. By way of example, the ports 302 can be made substantially of aluminum and/or aluminum alloys.

Within each gap between adjacent refrigerant channels 212, a fin 304 can be positioned to provide structural stability and enhanced heat transfer capabilities when ambient air is directed across the refrigerant channels 212. The fin 304 can be affixed to each adjacent refrigerant channel 212 at a plurality of attachment points along each refrigerant channel 212. The fin 304 can be affixed to each adjacent refrigerant channel by furnace brazing, welding, or any other attachment mechanism. Each fin 304 can have any configuration that creates a plurality of air flow passages that direct ambient air across the refrigerant channels 212 and/or fins 304 and into the internal cavity 214. Each fin 304 can be a unitary piece of metal having a substantially wave-like configuration, as illustrated in FIG. 3A. Alternatively, each fin 304 can be a unitary piece of metal having a substantially corrugated configuration. Each fin 304 can include a plurality of flat metal plates arranged in a louvered configuration. The plurality of fins 304 can be made substantially of any metal and/or a metal alloy. By way of example, the fins 304 can be made substantially of aluminum and/or aluminum alloys. Optionally, the fins 304 can be coated with hydrophobic coating to help prevent moisture and/or condensate from the ambient air accumulating on the exterior surface of the fins 304.

Some or all of the fins 304 can have a downward angle configuration. For example, some of all of the fins 304 can be angled upward and radially inward toward the center of the internal cavity 214. Alternatively, some of all of the fins 304 can be angled downward and radially inward toward the center of the internal cavity 214. The fins 304 can be angled regardless of whether the refrigerant channels 212 are angled. Further, the fins 304 can be angled in a different direction and/or to a different degree than an angle of the refrigerant channels 212.

Figure 3B:
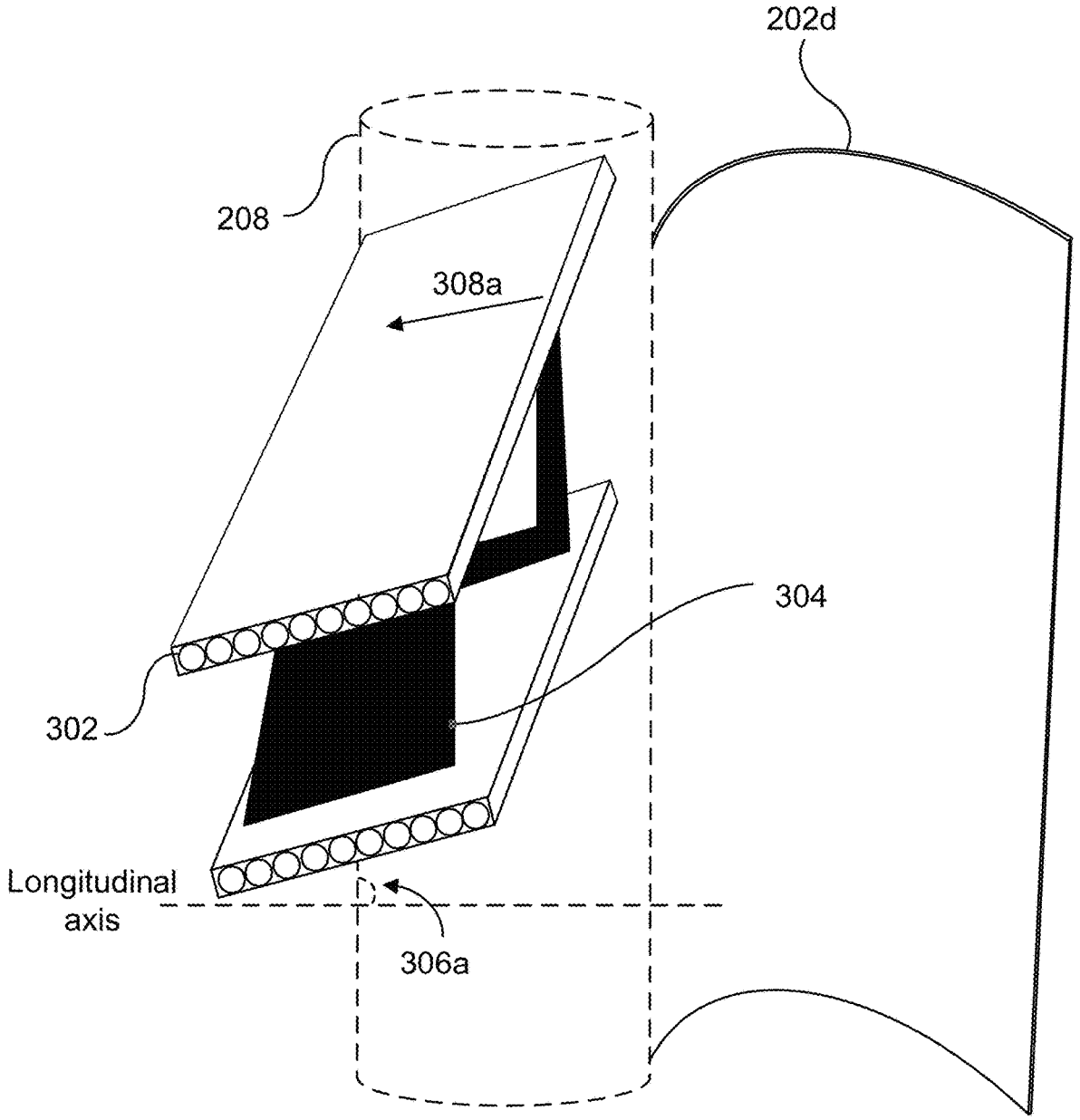
FIGS. 3B and 3C illustrate example evaporators, each having a plurality of angled refrigerant channels, in accordance with the disclosed technology.
Figure 3C:
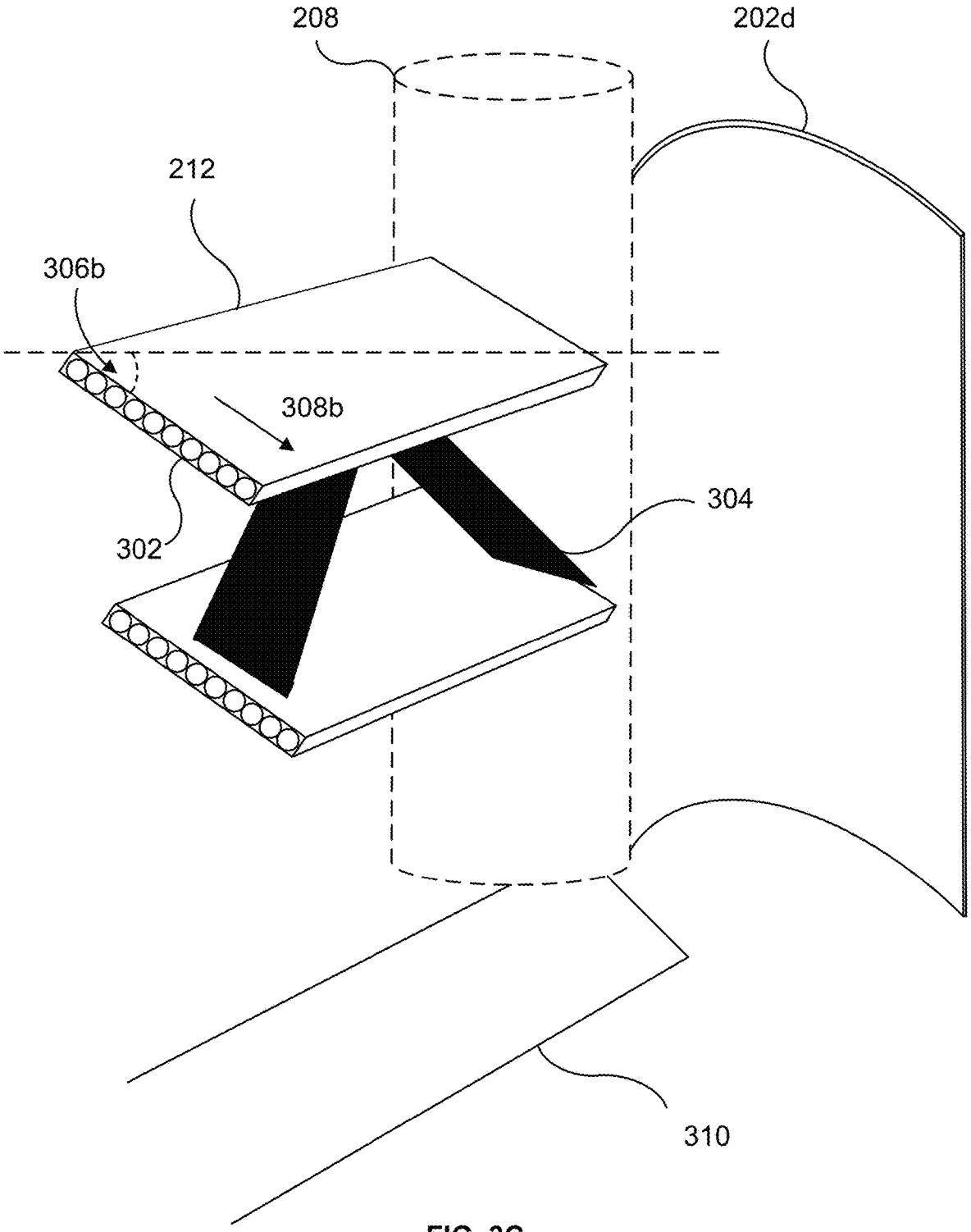

FIGS. 3B and 3C are schematic illustrations of the example evaporator 200 having angled refrigerant channels 212. As illustrated in FIG. 3B, each refrigerant channel 212 can be affixed to the refrigerant inlet 208 at an angle 306*a* with respect to a longitudinal axis such that each refrigerant channel 212 is angled upward and radially inward toward the internal cavity 214. The angle 306*a* can be an acute angle with respect to horizontal. The angle 306*a* can be between approximately 5 degrees and approximately 30 degrees. The angle 306*a* can be between approximately 5 degrees and approximately 15 degrees. The angle 306*a* can be between approximately 15 degrees and approximately 25 degrees. The angle 306*a* can be between approximately 25 degrees and approximately 30 degrees. As additional examples, the angle 306*a* can be between approximately 30 degrees and approximately 60 degrees (e.g., between approximately 30 degrees and approximately 45 degrees, between approximately 45 degrees and approximately 60 degrees).

Moisture from ambient air flowing across the refrigerant channels 212 and fins 304 can condensate out of the air and accumulate on the exterior surfaces of the refrigerant channels 212 and/or fins 304. During some operating conditions of a heat pump water heater, the moisture condensing can create frost and/or ice on the exterior surfaces of the refrigerant channels 212 and/or fins 304. Freezing on the various components of the evaporator 200 can reduce the efficiency and/or lifespan of the evaporator 200 and can lead to the need of frequent maintenance.

When each refrigerant channel 212 is angled as illustrated in FIG. 3B, a first flow path 308*a* for moisture and/or condensate can be created. The first flow path 308*a* can direct moisture and/or condensate from the refrigerant channels 212 and/or fins 304 to the exterior of the evaporator 200. By providing the first flow path 308*a*, minimal moisture and/or condensate can accumulate along the refrigerant channels 212 and/or fins 304, thereby the potential for freezing can be reduced. Optionally, the refrigerant channels 212 can include a hydrophobic coating to further reduce moisture and/or condensate from accumulating.

As illustrated in FIG. 3C, each refrigerant channel 212 can be affixed to the refrigerant inlet 208 at an angle with respect to a longitudinal axis such that the entire refrigerant channel 212 is angled downward and radially inward toward the internal cavity 214. The angle 306*b* can be an acute angle with respect to horizontal. The angle 306*b* can be between approximately 5 degrees and approximately 30 degrees. The angle 306*b* can be between approximately 5 degrees and approximately 15 degrees. The angle 306*b* can be between 15 degrees and approximately 25 degrees. The angle 306*b* can be between 25 degrees and approximately 30 degrees. As additional examples, the angle 306*b* can be between approximately 30 degrees and approximately 60 degrees (e.g., between approximately 30 degrees and approximately 45 degrees, between approximately 45 degrees and approximately 60 degrees).

When each refrigerant channel 212 is angled as illustrated in FIG. 3C, a second flow path 308*b* for moisture and/or condensate can be created. The second flow path 308*b* can direct moisture and/or condensate from the refrigerant channels and/or fins to the interior cavity 214. A drain pan 310 can be positioned within the internal cavity 214 to collect the moisture and/or condensate shedding from the refrigerant channels 212. By providing the second flow path 308*b*, minimal moisture and/or condensate can accumulate along the refrigerant channels 212 and/or fins 304, thereby the potential for freezing can be reduced. Optionally, the refrigerant channels 212 can include a hydrophobic coating to further reduce moisture and/or condensate from accumulating.

Figure 4:
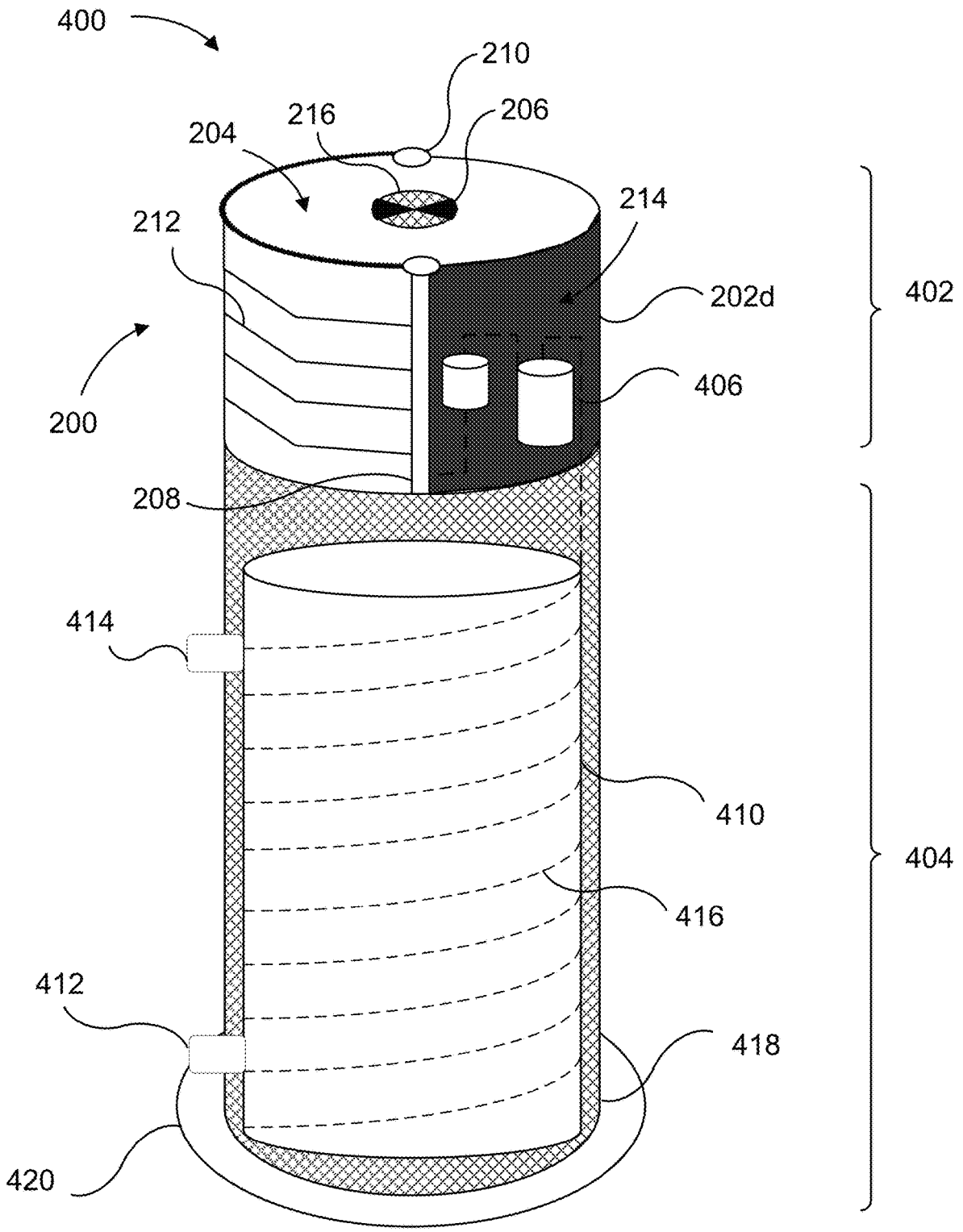
FIG. 4 illustrates a schematic of an example heat pump water heater, in accordance with the disclosed technology.

FIG. 4 illustrates a schematic illustration of a heat pump water heater 400 having an evaporator 200. The heat pump water heater 400 can have a top portion 402 and a bottom portion 404. The top portion 402 can be the evaporator 200. The evaporator 200 can include a plurality of sidewalls 202. At least one of the sidewalls 202 can include the plurality of refrigerant channels 212 such that at least one of the sidewalls 202 can function as a heat exchanger. The refrigerant channels 212 can extend from the refrigerant inlet 208 to the refrigerant outlet 210. As illustrated in FIG. 4, the plurality of refrigerant channels 212 can extend substantially half of the exterior surface of the top portion 402 (i.e. the evaporator 200). Alternatively, the plurality of refrigerant channels 212 can extend greater than half of the exterior surface of the top portion 402 or less than half of the exterior surface of the top portion 402.

The sidewall(s) 202 of the evaporator 200 that do not include the plurality of refrigerant channels 212 (e.g., sidewall 202*d*) can provide structure and stability and protect the components of the heat pump water heater 400 disposed within the internal cavity 214. The sidewall 202*d* can be made of any insulating material. By way of example, the sidewall 202*d* can be made of insulating metal(s) and/or plastic. Unlike the prior art heat pump water heater 100 illustrated in FIGS. 1A and 1B that required an outer jacket around the entire top portion of the heat pump water heater, the heat pump water heater 400 can be devoid of a separate outer jacket surrounding the top portion 402, as the sidewall 202*d* (and/or other sidewalls of the evaporator 200) can function as an outer jacket. By eliminating the need for additional parts and components, manufacturing costs and installation and maintenance time can be reduced.

The top plate 204 can include an aperture sized to receive the fan 206. The top portion 402 can include a compressor 406. The compressor 406 can be disposed within the internal cavity 214 of evaporator 200.

The bottom portion 404 can include a storage tank 410. The storage tank 410 can store fluid, including water. The storage tank 410 can receive unheated fluid via an inlet 412 and output heated fluid via an outlet 414. A condenser coil 416 can be disposed proximate the storage tank 410. As illustrated in FIG. 4, the condenser coil 416 can be wrapped around the storage tank 410. An outer jacket 418 can surround the storage tank 410. The outer jacket 418 can provide increased structure and stability as well as insulation. The outer jacket 418 can be made of one or more metals, plastic, or any material designed to provide protection and insulation. An exterior drain pan 420 can surround a base of the heat pump water heater 400. The exterior drain pan 420 can surround the entire circumference of the base of the heat pump water heater 400. Alternatively, the drain pan 420 can surround the portion of the circumference of the base of the heat pump water heater 400 that aligns with the portion of the evaporator 400 having refrigerant channels 212 as sidewalls 202. The exterior drain pain 420 can collect moisture and/or condensate that can shed from the plurality of refrigerant channels 212 and the fins 304 due to the refrigerant channels being angled as illustrated in FIG. 3B.

What is claimed is:

1. An evaporator comprising:

a plurality of sidewalls arranged to define an internal cavity, at least one of the sidewalls including a plurality of refrigerant channels configured to transport refrigerant therethrough; and a top plate covering the internal cavity.

2. The evaporator of claim 1, wherein the top plate comprises an aperture configured to receive a fan.

3. The evaporator of claim 1, wherein each refrigerant channel includes a plurality of ports, each port configured to provide a refrigerant flow path from a refrigerant inlet to a refrigerant outlet.

4. The evaporator of claim 1, wherein each refrigerant channel is angled such that ambient air is directed across the plurality of refrigerant channels and into the internal cavity.

5. The evaporator of claim 4, wherein each refrigerant channel is angled upward and radially inward toward a center of the internal cavity.

6. The evaporator of claim 5, wherein each refrigerant channel is angled upward and radially inward toward the center of the cavity at a degree of between approximately 5 degrees and approximately 30 degrees.

7. The evaporator of claim 5, wherein each refrigerant channel is angled such that condensate forming on a particular refrigerant channel flows in a flow path from the particular refrigerant channel to a desired location.

8. The evaporator of claim 7, wherein the desired location is a drain pan.

9. The evaporator of claim 4, wherein each refrigerant channel is angled downward and radially inward toward a center of the cavity.

10. The evaporator of claim 9, wherein each refrigerant channel is angled downward and radially inward toward the center of the cavity at a degree of between approximately 5 degrees and approximately 30 degrees.

11. The evaporator of claim 1, wherein at least some of the refrigerant channels are at least partially covered with a hydrophobic coating.

12. A heat pump water heater comprising:

a first portion comprising:

an evaporator including:

a plurality of sidewalls arranged to define an internal cavity, at least one of the sidewalls including a plurality of refrigerant channels; and a top plate covering the internal cavity, the top plate having an aperture configured to receive a fan; and a compressor; and a second portion comprising:

a storage tank; and a condenser coil in thermal communication with the storage tank.

13. The evaporator of claim 12, wherein each refrigerant channel is angled such that ambient air is directed across the plurality of refrigerant channels and into the internal cavity.

14. The evaporator of claim 13, wherein each refrigerant channel is angled upward and radially inward toward a center of the cavity.

15. The evaporator of claim 14, wherein each refrigerant channel is angled such that condensate forming on a particular refrigerant channel flows in a flow path the particular refrigerant channel to an exterior drain pan.

16. The evaporator of claim 13, wherein each refrigerant channel is angled downward and radially inward toward a center of the internal cavity.

17. The evaporator of claim 16, wherein each refrigerant channel is angled such that condensate forming on a particular refrigerant channel flows in a flow path from the particular refrigerant channel to an interior drain pan disposed within the internal cavity.

18. The heat pump water heater of claim 12, wherein the plurality of refrigerant channels extends along approximately half of an exterior surface of the first portion.

19. The heat pump water heater of claim 18, wherein one or more sidewalls devoid of the plurality of refrigerant channels extends along approximately half of the exterior surface of the first portion.

20. The heat pump water heater of claim 12, further comprising an outer jacket surrounding the second portion.

* * * * *